US005964623A

United States Patent [19]

Maher et al.

[11] Patent Number: 5,964,623

[45] Date of Patent: Oct. 12, 1999

[54] EASILY GRIPPED CIGARETTE LIGHTER ADAPTER WITH BALANCED, SOLDERLESS GROUND CONTACTS

[75] Inventors: Eugene D. Maher, Mundelein; John Claypoole, Naperville; Christopher R. Jones, Oak Lawn; Kevin Campbell, Des Plaines; Francisco Xavier Gomez, Melrose Park; Alvaro Mejia, Bartlett, all of Ill.

[73] Assignee: Andrew Corporation, Addison, Ill.

[21] Appl. No.: 09/015,681

[22] Filed: Jan. 29, 1998

[51] Int. Cl.[6] ..... H01R 17/18

[52] U.S. Cl. ..... 439/668; 439/483

[58] Field of Search ..... 439/668, 669, 439/638, 265, 476, 481, 483, 933

[56] References Cited

U.S. PATENT DOCUMENTS

| | | | |
|---|---|---|---|
| 1,949,596 | 3/1934 | Anderson | 439/483 |
| 2,252,553 | 8/1941 | Campbell | 439/483 |
| 2,605,318 | 7/1952 | Morgenstern | 439/668 |
| 2,954,544 | 9/1960 | Focosi | 439/668 |
| 4,322,122 | 3/1982 | Schwartz et al. | 439/668 |
| 4,459,463 | 7/1984 | Knowles | 439/481 |
| 4,604,529 | 8/1986 | Grimsley et al. | 439/668 |
| 4,682,139 | 7/1987 | Kuo | 337/185 |
| 4,789,361 | 12/1988 | Kinzalow et al. | 439/622 |
| 5,131,869 | 7/1992 | Wharton | 439/622 |
| 5,170,067 | 12/1992 | Baum et al. | 439/668 |
| 5,199,904 | 4/1993 | Wharton | 439/668 |
| 5,201,677 | 4/1993 | Takayama | 439/668 |
| 5,261,838 | 11/1993 | Fujie | 439/668 |
| 5,431,585 | 7/1995 | Fan | 439/668 |
| 5,569,053 | 10/1996 | Nelson et al. | 439/668 |
| 5,593,323 | 1/1997 | Dernehl | 439/668 |
| 5,626,496 | 5/1997 | Hanh | 439/668 |

*Primary Examiner*—Paula Bradley
*Assistant Examiner*—Tho D. Ta
*Attorney, Agent, or Firm*—Vedder Price Kaufman & Kammholz

[57] ABSTRACT

An improved cigarette lighter adapter for an electronic device has an exterior flexible covering that provides a textured surface for gripping by the user to facilitate the insertion and removal of the adapter from a cigarette lighter socket. The adapted also includes a pair of ground contacts in the form of spring members that abut ground contact pads on an internal circuit board. The ground contacts are biased in place within the adapter against the circuit board contact pads in a solderless manner. The ground contacts are positioned in alignment with each other on opposite sides of the circuit board so that contact forces they exert on the circuit board balance so as not to apply any detrimental stress to the circuit board.

19 Claims, 3 Drawing Sheets

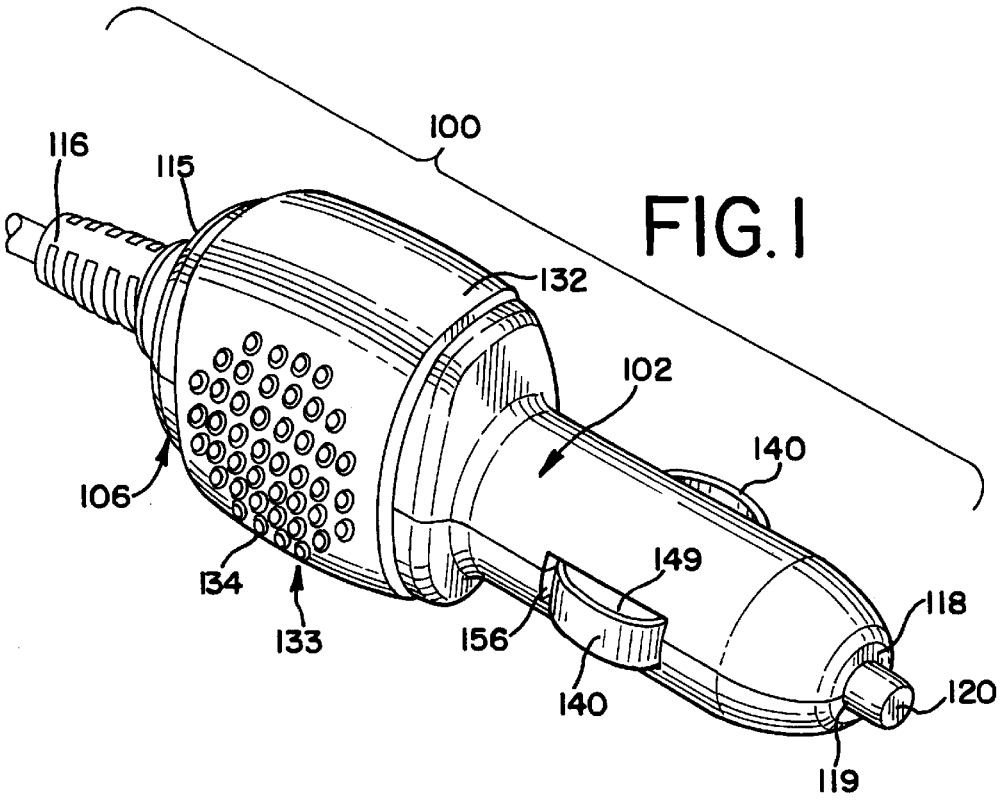
FIG. 1
FIG. 2
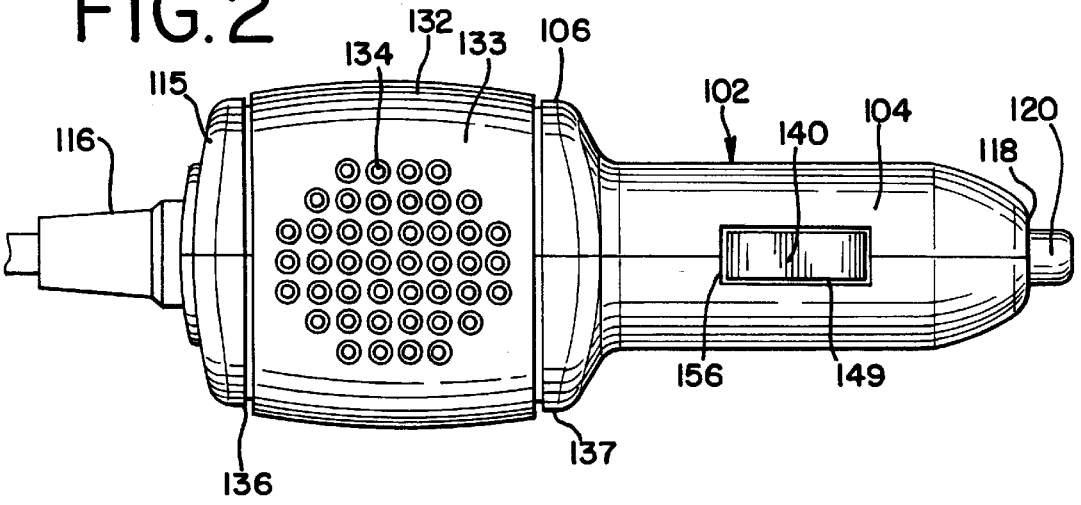

EASILY GRIPPED CIGARETTE LIGHTER ADAPTER WITH BALANCED, SOLDERLESS GROUND CONTACTS

BACKGROUND OF THE INVENTION

The present invention relates generally to cellular telephones, and more particularly to adapters that adapt a cellular telephone for use in a vehicle.

Cellular telephones are extremely popular and are being used by a larger segment of the population hand-held cellular telephones may be used by their owners either in or outside of vehicles. When the telephone is one that is normally carried by the user, an adapter is required to run the telephone off of the vehicle electrical power rather than the telephone battery. The present invention is directed to an adapter for a cellular telephone that utilizes solderless ground contacts.

The prior art describes a number of adapters that permit operation of various electronic devices from the electrical power source of a vehicle. These adapters all share certain common components. Each adapter must have a "hot" contact that is connected to the vehicle "hot" source of power, and each adapter must have a "return" or "ground" contact that is connected to the ground of the vehicle.

Some of these adapters utilize internal circuit boards and have their ground contacts connected directly to the circuit board, such as by soldering. The soldered joint may be positioned on the circuit board in an area where it undergoes great stress, inasmuch as the adapter ground contacts are typically themselves compressed when inserted into a cigarette lighter receptacle. The present invention is directed to an adapter that utilizes a solderless connection for its ground contacts, and positions the ground contacts in such a manner that any contact forces exerted by the contacts on the adapter circuit board balance each other so as not to apply any detrimental, unbalanced stress to the circuit board or other part of the adapter.

Adapters of the prior art also contain charging circuits that charge the telephone battery while connected to the vehicle. These charging circuits give off heat and may increase the temperature of the adapter to one that is uncomfortably warm to the user. The present invention overcomes this problem by utilizing a flexible, textured and insulative cover that lies over a portion of the surface of the adapter.

SUMMARY OF THE INVENTION

Accordingly, it is a general object of the present invention to provide an improved adapter for connecting a cellular telephone to a source of electrical power in a vehicle.

Another object of the present invention is to provide an adapter for connecting a cellular telephone to a vehicle's cigarette lighter receptacle, wherein the adapter has an internal circuit board containing a charging and connection circuits, and a pair of ground contacts that connect the circuit grounds to the vehicle grounds, wherein the ground contacts abut the circuit board in a solderless connection.

Still another object of the present invention is to provide a cigarette lighter adapter that provides an electrical connection between a cigarette lighter of a vehicle and a cellular telephone, the adapter having a charging and connection circuit disposed on a circuit board held within an adapter housing, the adapter having a pair of ground contacts in the form of spring members, each of the spring members being held within the adapter housing in confronting relationship to each other and to a common point on the circuit board, the spring members exerting substantially equal contact forces on the circuit board when the adapter is inserted into the vehicle cigarette lighter receptacle.

Yet another object of the present invention is to provide a cigarette light adapter for a cellular telephone with a separate grip portion that encloses a portion of the adapter housing, the grip portion providing a textured surface for a user to grip and the grip further providing an insulative covering to the adapter.

These objects are accomplished by at least one principal aspect of the present invention in which the adapter has a housing for housing its relevant components, the housing containing a circuit board therein, the circuit board having a ground circuit defined therein on with one or more contact pads disposed. A pair of resilient spring members are provided as ground contacts and are held within the adapter housing in opposition to the ground circuit contact pad(s). The spring members contact the ground contact pad(s) and are further forced in contact therewith when the ground contacts become compressed during insertion of the adapter into a cigarette lighter receptacle.

In another principal aspect of the present invention and as exemplified by the preferred embodiment, the ground contacts take the form of spring members, with each spring member having a contact base and a cantilevered contact arm that extends therefrom and over the contact base. The contact base is held within the adapter housing in a manner such that it may pivot or rock into firmer contact with the circuit board contact pad(s). The spring members are positioned within the adapter in opposition to each other so that the contact forces that they exert on the circuit board, whether the adapter is in or out of a cigarette lighter receptacle, substantially balance each other so as not to apply any detrimental stress to the circuit board.

In an additional principal aspect of the present invention, the adapter includes an exterior grip portion that is formed from a resilient material, such as an elastomer or soft plastic. The grip portion may have a textured pattern formed thereon and the grip portion overlies the main body portion of the adapter housing. The grip portion also provides a measure of heat insulation to the adapter.

These and other objects, features and advantages of the present invention will become apparent from the following detailed description, taken in conjunction with the accompanying drawings, wherein like reference numerals refer to like parts.

BRIEF DESCRIPTION OF THE DRAWINGS

In the course of this detailed description, reference will be made to the accompanying drawings in which:

FIG. 1 is a perspective view of a cigarette lighter adapter constructed in accordance with the principles of the present invention;

FIG. 2 is an elevational view of the right side of the adapter of FIG. 1;

DETAILED DESCRIPTION OF THE INVENTION

Figure 3:
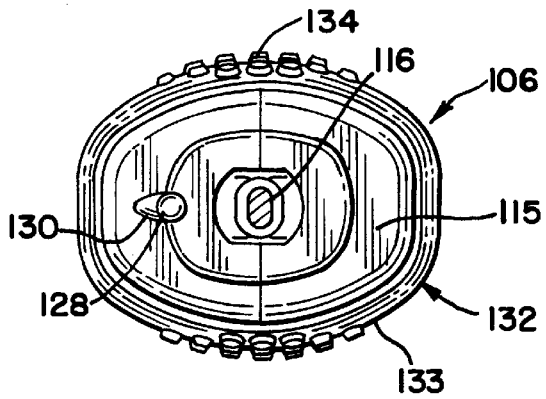
FIG. 3 is an elevational view of the rear end of the adapter of FIG. 1.

FIG. 1 illustrates a cigarette lighter adapter 100 constructed in accordance with the principles of the present invention. The adapter 100 is insertable into a cigarette lighter socket 101 (FIG. 8) of a vehicle to draw power from the vehicle in order to power an electronic device, such as cellular telephone. The adapter 100 has a plastic housing 102 that encloses the relevant components thereof and may be considered as having two interconnected sections. One section includes an elongated, cylindrical barrel portion 104 having a diameter that is dimensioned to be received within the vehicle lighter socket 101. The second section is a main body portion 106 that is attached to, but is generally larger than the barrel portion 104. The main body portion 106 and the barrel portion 104 are hollow so that they cooperatively form an internal cavity of the adapter 100 that houses and encloses the electronic components of the adapter 100.

Figure 5:
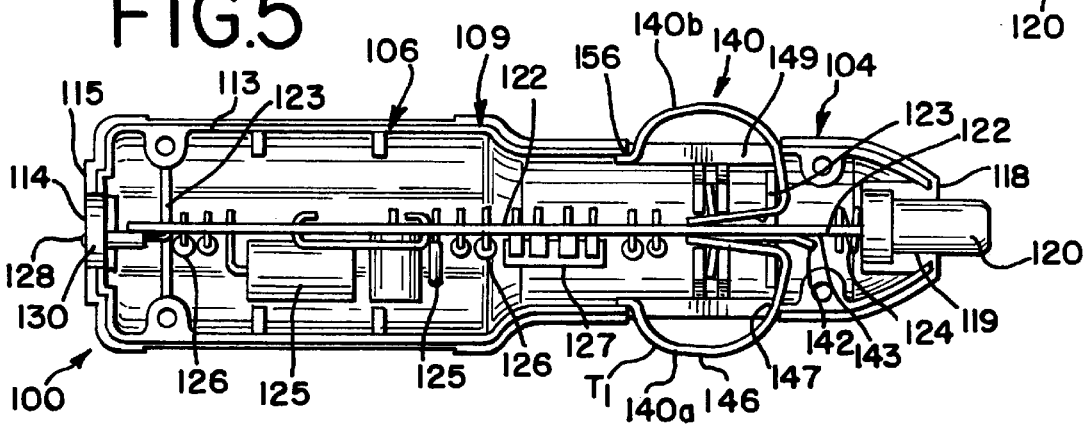
FIG. 5 is an elevational view of the adapter of FIG. 1 with one of the housing halves and the exterior grip cover removed for clarity, illustrating the internal mounting of the adapter components therein.

The barrel and main body portions 104 & 106 of the adapter 100 may be easily formed from a plastic by a suitable process such as injection molding. The adapter housing 102 may be formed by molding two opposing halves 108, 109 which engage each other. One such half 109 is illustrated in FIG. 5 and the housing half 109 includes recessed female receptacles 110 form in boss sections 112 of the housing. These receptacles 110 receive male pins (not shown) that project from the other housing half 108 and the engagement between the two housing halves 108, 109 is in the manner of a press-fit engagement. An interior lip 113 may be provided along the interior edges of the housing half 109 and this lip may be received in a corresponding recess of the other housing half 108.

Each housing half 108, 109 includes a passage 114 formed in the rear wall 115 thereof through which an electrical cord 116 extends for connection to the electronic device (not shown). At the forward end 118, each housing half 108, 109 includes a similar cylindrical passage 119 formed therein which accommodates a cylindrical conductive tip contact 120. This tip contact engages, as is known in the art, a "hot" contact of the vehicle electrical system that is typically disposed at the center and end portion of the cigarette lighter socket 101. This tip contact 120 is electrically connected in a conventional manner to one or more "hot" or "live" circuits disposed on a circuit board 122. This connection is illustrated in FIG. 5 as a conductive spring 124 that biases the tip contact 120 forwardly within the housing end passage 119. The spring 124 is connected to the circuit board in a suitable manner such as soldering. The circuit board 122 is maintained at a preselected level within the adapter housing 102 by way of support ribs 123 that may be formed integrally with the housing halves 108, 109.

The circuits disposed on the circuit board 122 may include a transformer circuit that either steps the voltage of the vehicle electrical system up or down to a level appropriate to run a specific electronic device, a charging circuit for charging the electronic device during operation, or even merely a circuit that provides a simple electrical connection between the vehicle and the electronic device. As such, the circuits may include electrical components such as capacitors 125, resistors 126 as well as integrated circuits in the form of chips 127. As part of the circuitry of the adapter 100, an indicator, such as a light-emitting diode ("LED") 128 may be provided and positioned within an opening 130 of the housing 102. This LED 128 indicates to the user that the adapter 100 is operational and a connection has been established with the vehicle electrical system through the lighter socket 102.

Figure 4:
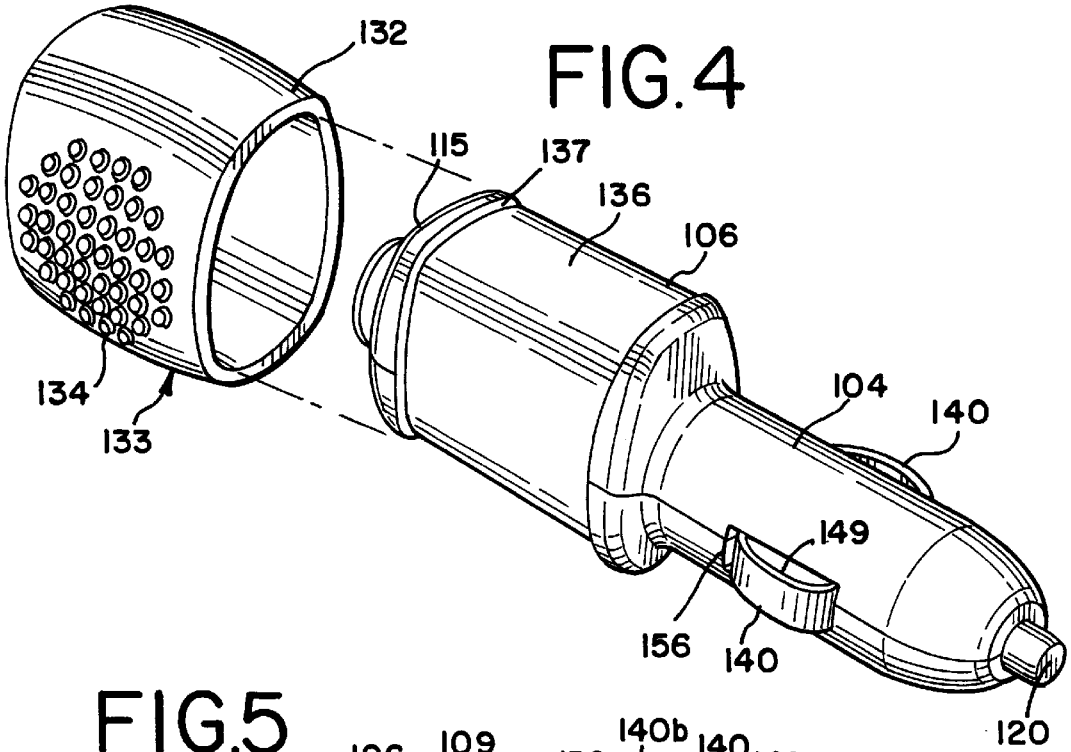
FIG. 4 is the same view as FIG. 1, but with the exterior grip cover removed therefrom.

In an important aspect of the invention, the adapter 100 includes a separate exterior cover 132 that is disposed over part of the main body portion 106 of the adapter housing 102. The cover 132 is preferably formed in a continuous loop as best illustrated in FIG. 4 and also preferably has an overall diameter that is slightly less than the overall diameter of the adapter main body portion 106. In this regard, the cover 132 assists in retaining the two housing halves 108, 109 together. To facilitate the gripping thereof by a user when either inserting or removing the adapter 100 from the cigarette lighter socket 101, the cover 132 may include textured portions 133 on opposite extents of the cover 132. These portions 133 may include a plurality of raised knob-like members 134 or any other similar pattern.

The cover 132 may be formed from a flexible or resilient material, such as rubber, an elastomer or a soft plastic. The circuitry of the adapter 100 inevitably produces heat during operation and in this regard, the cover 132 provides an insulating layer for the adapter 100. The cover 132 also provides a soft exterior surface that may be reliably gripped by the user regardless of the surrounding temperature. As mentioned above, the flexible cover 132 has an slightly smaller overall diameter than the main body portion 106, and the cover 132 overlies the main body portion 106 in a recessed area 136 that is formed between two raised edge or wall portions 137.

Figure 8:
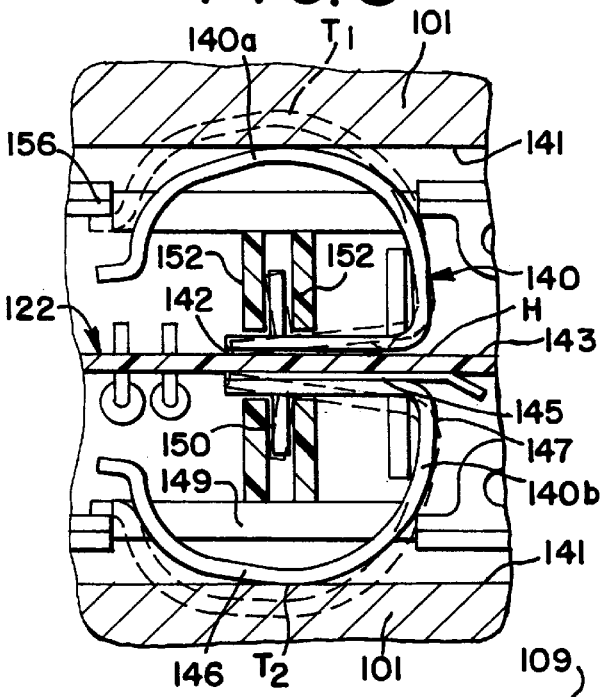
FIG. 8 is an enlarged view of a portion of the adapter of FIG. 5, illustrating in detail the contact that occurs between the ground contact members and circuit board when the adapter is inserted into a cigarette lighter receptacle.
Figure 9:
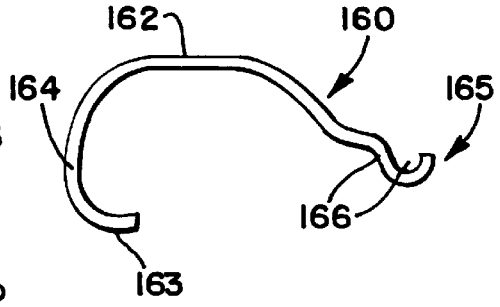
FIG. 9 is an elevational view of another embodiment of a ground contact member useful in the adapter of FIG. 1.
Figure 11:
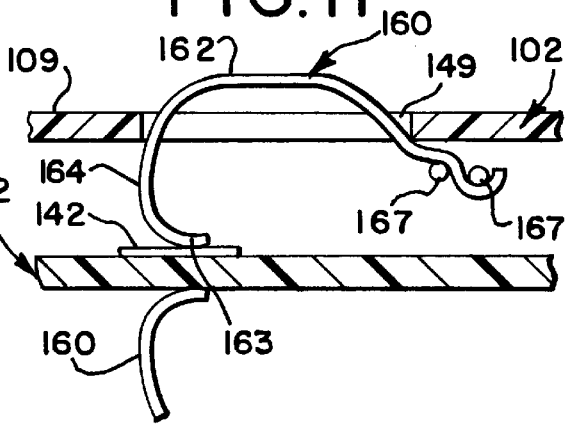

In another important aspect of the invention, the adapter 100 includes a pair of contact members 140 that provide a ground path or contact between a ground of the adapter circuitry and a ground of the vehicle electrical system. The vehicle system ground typically includes the interior walls 141 of the cigarette lighter socket 101 (FIG. 8). The ground circuit of the adapter may terminate in one contact pad 142 disposed on one surface 143 of the circuit board 122, as illustrated in FIGS. 5 & 8 or it may include two such contact pads disposed on opposite surfaces of the circuit board 122. In any event, the contact members 140 are maintained in contact with the ground circuit in a solderless manner, thereby saving in assembly costs of the adapter 100 as well as prolonging the life of the adapter 100.

Figure 7:
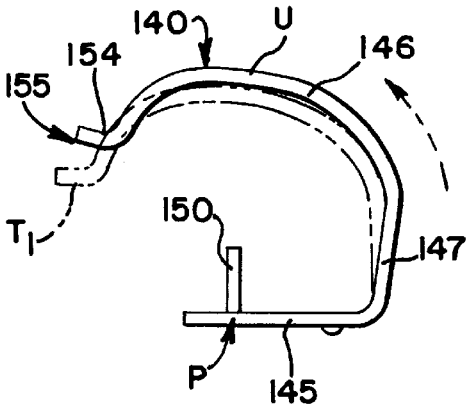
FIG. 7 is an elevational view of the ground contact member of FIG. 6, illustrating its spring movement.

As best illustrated in FIG. 7, the contact member 140 possesses a generally C-shape with a base portion 145 and a contact arm portion 146 that extends from the base portion 145 in a cantilevered fashion. The base and contact arm portions 145, 146 are interconnected by a bight portion 147. The contact member 140 is formed from a resilient material such as a spring steel or copper and may be plated to increase its conductivity. The contact arm portions 146 are spaced apart from the base portion 145 a preselected distance so that they will project out of a pair of openings 149 formed in the housing halves 108 & 109.

The contact members 140*a*, 140*b* are positioned within the housing halves 108, 109 in confronting alignment with each other and on opposite sides of the circuit board 122. At least one of the contact members 140*a* is aligned with one ground contact pad 142 so that the base portions 145 generally abut the contact pad 142. Each base portion 145 includes a retention leg 150 that is formed near the end thereof. The legs 150 are held in place between two retaining blocks 152 that are formed with the housing half 109 and extend within the interior of the housing half 109 above the level of the circuit board 122. The contact members 140 further include step portions 154 at the free ends 155 of the contact arm portions 146. These step portions 154 are angularly offset from the base portion retention legs 150 and engage opposing edges 156 of the housing contact openings 149. Thus, it can be seen that the contact members 140 are held in place within the housing 102 at opposite free ends of the contact members.

Figure 6:
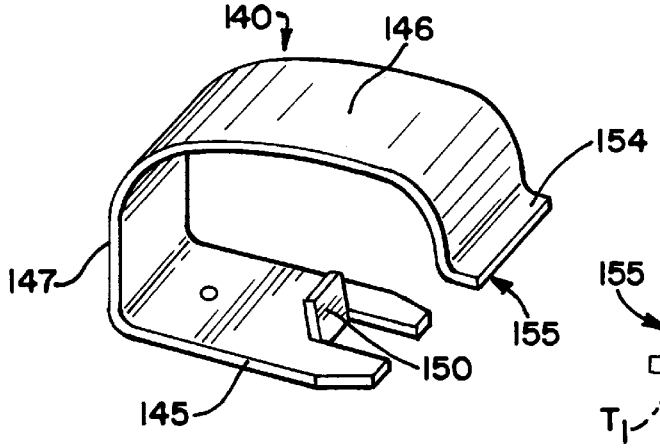
FIG. 6 is a perspective view of a ground contact member used in the adapter of FIG. 1.

The leg portions 150 of the contact members 140 are positioned between the retaining blocks 152 of the housing half 109. Preferably, the spacing between the pairs of retaining blocks 152 is large enough to permit a slight amount of "play" between the contact member retention leg portion 150 and the retaining blocks 152 so that the contact member 140 may rock or pivot while so held. Prior to insertion of the contact members 140 into the housing half 109, the contact arm portions 146 are depressed from the untensioned state illustrated in FIGS. 6 & 7 by U to the first tensioned state shown in phantom in FIG. 7 and indicated by $T_1$ whereupon the step portion 154 engages the edge 156 of the contact opening 149.

When the second contact members 140 are inserted into the adapter housing half 109 as shown in FIG. 5, the contact arm portions 146 slightly deflect toward the interior of the adapter housing and the step portions 154 are depressed when they contact the cigarette lighter socket 101. As this occurs, the contact base portion 145 slightly rotates or rocks around point P that occurs roughly at the junction of the base portion 145 and the leg portion 150. This rotation/rocking is in a counterclockwise direction as represented by the phantom arrow in FIG. 7. This movement results in part of the base portion 145 being lifted away from the circuit board 122 and the contact pad 142, Both contact members 140 are so moved so that any force exerted by them on the circuit board occurs in direct opposition to each other.

When the adapter 100 is inserted into a cigarette lighter socket 101 as best illustrated in FIG. 8, the contact members 140 are further moved into a second tensioned state $T_2$ (FIG. 8). In this state, the contact arm portions 146 are evenly depressed or deflected by the interior walls 141 of the cigarette lighter socket 101 toward the interior of the adapter housing 100, thereby causing the contact members 140 to rock/rotate clockwise around P to a position where the base portions 145 thereof are urged into total contact against the circuit board 122 with a positive force against the circuit board 122 and contact pad(s) 142 thereon, i.e., the contact member base portions 145 are not longer slightly lifted away from the circuit board 132 at H. Preferably, the dimensions of each contact member 140*a*, 140*b* are substantially identical so that in both the first and second tensioned states $T_1$, $T_2$, the base portions 145 are generally aligned with each other on opposite sides of the circuit board 122 so that the contact members 140 exert equal forces that balance, or cancel, each other so as not to exert any detrimental uneven stress on the circuit board 122. This design, in effect is one where the contact members 140 exert a balancing force on the circuit board 122.

Figure 10:
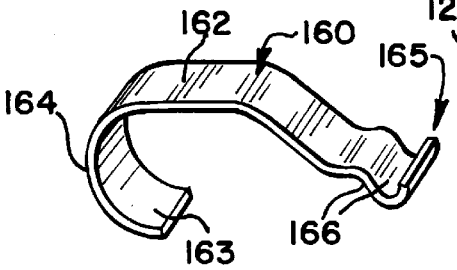
FIG. 10 is a perspective view of the ground contact member of FIG. 9; and, FIG. 11 is an enlarged view of the ground contact member of FIG. 9 inserted in an adapter.

FIG. 10 illustrates a second embodiment of a contact member 160 constructed in accordance with the principles of the present invention. This contact member 160 includes a spring member 161 that has a projecting contact arm portion 162, a base portion 163 that engages a circuit board 122 and any contact pad 142 disposed thereon. The contact arm portion 162 is connected to the base portion 163 by an intervening bight portion 164 and extends over the base portion 163 in a cantilevered fashion. The contact arm portion 162 terminates in a free end 165 that includes a housing engagement portion, or step 166, that engages a pair of lugs 167 formed in the housing 102. Contact which occurs between the contact arm portions 162 and the interior walls 141 of the lighter socket 101 applies a force to the base portion 163 to maintain it in contact with the contact pad 142 and circuit board 122.

The contact members of the present invention may be easily manufactured by a suitable process, such as stamping and forming and the solderless contact that occurs between them and the circuit board eliminates the need for a soldered joint which may deteriorate over time with repeated insertion and removal cycles of the adapter.

It will be understood that the embodiment of the present invention which has been described herein is merely illustrative of some of applications of the principles of the present invention. Various modifications may be made by those skilled in the art without departing from the true spirit and scope of the invention.

We claim:

1. An adapter for establishing an electrical connection between an electrical power system of a vehicle and an electronic device situated within an interior portion of the vehicle, said vehicle having a cigarette lighter receptacle and the vehicle power system having a hot contact and a ground contact associated with said cigarette lighter receptacle, the adapter comprising:

an elongated housing, the adapter housing having a body portion and a barrel portion sized to fit within said cigarette lighter receptacle, the adapter housing having an internal cavity extending between said body and barrel portions;

a circuit board disposed within said housing, the circuit board having a connecting circuit disposed thereon for providing a connection between said electronic device and said vehicle power system, said connecting circuit including a hot portion and a ground portion;

a first contact member disposed in said adapter housing barrel portion in opposition to said cigarette lighter receptacle hot contact, said first contact member being connected to said connecting circuit hot portion; and, a pair of second contact members disposed in said adapter housing barrel portion in opposition to said cigarette light receptacle ground contact, each of said second contact members having a base portion and a contact arm portion, said base and contact arm portions each further including a free end, said free end portions being angularly disposed with respect to each other, said base portion free end being engaged by said adapter housing and said contact arm free end engaging said adapter housing, said engagement of said second contact member free ends biasing said second contact members into a first tensioned position wherein said second contact member base portions contact with said circuit board and said connecting circuit ground portion thereof, said second contact members being disposed in opposing alignment with each other on opposite sides of said circuit board such that forces they exert upon said circuit board when in said first tensioned position generally balance each other to thereby avoid the imposition of detrimental unbalanced stress on said circuit board.

2. The adapter as defined in claim 1, wherein said adapter housing barrel portion includes a pair of openings that partially receive said second contact members therein and each of said second contact member contact arm portion free ends includes a step portion that engages an edge of said contact openings.

3. The adapter as defined in claim 1, wherein said contact that occurs between said second contact members and said circuit board and connecting circuit ground portion is a frictional contact.

4. The adapter as defined in claim 1, wherein said second contact member contact arm portions are free to deflect toward an interior of said adapter housing when said adapter is inserted into said cigarette lighter receptacle.

5. The adapter as defined in claim 1, further including a flexible exterior cover overlying said main body portion.

6. The adapter as defined in claim 5, wherein said exterior cover is a continuous collar member formed from an elastomeric material.

7. The adapter as defined in claim 1, wherein each of said contact members has a general C-shape and said base and contact arm portions are interconnected by a bight portion.

8. The adapter as defined in claim 7, wherein each of said second contact member base portion free ends include a retention leg formed thereon, the retention legs being angularly disposed with respect to said second contact member base member, said retention legs engaging said adapter housing.

9. The adapter as defined in claim 1, wherein said adapter housing is formed with two opposing, mating halves.

10. The adapter as defined in claim 9, wherein each of said adapter housing mating halves includes at least one pair of retaining members formed on an interior surface thereof and disposed within said adapter housing barrel portion, and wherein each of said second contact member base portion free ends include a retention leg formed thereon, the retention legs being angularly disposed with respect to said second contact member base member, said retention legs being disposed between said retaining members that permits slight movement therein.

11. The adapter as defined in claim 10, wherein said second contact member contact arm portions are free to deflect toward an interior of said adapter housing when said adapter is inserted into said cigarette lighter receptacle and wherein, when said adapter is inserted into said cigarette lighter receptacle, said second contact members move about a movement point proximate to said contact member base portions with respect to said circuit board into contact along substantially said entire contact member base portions.

12. A cigarette lighter adapter assembly, comprising: a longitudinally extending adapter body having sidewalls and opposing front and rear endwalls that cooperatively define a hollow interior, a first contact opening extending through said front endwall and at least one second contact opening extending through one of said sidewalls, the adapter body being formed from an electrically insulative material, a first contact member formed from an electrically conductive material, the first contact member partially extending through said adapter body first contact opening, at least one second contact member also formed from an electrically conductive material and partially extending through said adapter body one second contact opening, said adapter body having a barrel portion that is insertable into a cigarette lighter receptacle, and a main body portion that extends outside of the cigarette lighter receptacle when said adapter body barrel portion is inserted into said cigarette lighter receptacle, and a flexible outer covering that surrounds said adapter main body portion, said outer covering having at least one textured portion disposed thereon to provide a reliable gripping surface for a user of said adapter during insertion or removal of said adapter from said cigarette lighter receptacle, said main body portion including a recess defined thereon that receives said outer covering, said adapter main body portion recess having an overall diameter and said outer covering having an overall diameter, said outer covering overall diameter being less than said adapter main body portion recess overall diameter such that said outer covering is snugly received on said adapter main body portion recess.

13. The cigarette lighter adapter assembly as defined in claim 12, wherein said outer covering is formed from a material different than a material from which said adapter body is formed.

14. The cigarette lighter adapter assembly as defined in claim 12, wherein said adapter body has two opposing sides and said outer covering includes two textured portions disposed proximate to said adapter body two sides.

15. The cigarette lighter adapter assembly as defined in claim 12, wherein said outer covering is formed from an elastomeric material.

16. The cigarette lighter adapter assembly as defined in claim 12, wherein said adapter body includes an additional second contact opening extending through another of said sidewalls and said adapter body further an additional second contact member, said one and additional second contact members being disposed on opposite sides of a longitudinal axis of said adapter body.

17. The cigarette lighter adapter assembly as defined in claim 16, wherein said one and additional second contact members have first and second free ends, said first free ends being held in place within said adapter body between pairs of retention members and said second free ends being biased against said adapter body second contact openings such that said one and additional second contact members ar free to deflect toward an interior of said adapter body.

18. A connector for connecting an electrical device to a vehicle electrical system, comprising: an elongated hollow body having a first opening and a pair of second openings formed therein, a circuit board disposed within said hollow body, a first conductive contact mounted within said body and partially extending through said first opening, a pair of second conductive contacts mounted within said body and partially extending through said second openings, said second contacts being disposed in opposite sides of said circuit board and further being aligned with each other, each of said second contacts having a generally flat base portions, a contact arm extending over said base portion, a first free end proximate to said base portion and said contact arm terminating in a second free end, said second contact first free ends being held within said body such that said contact base portions oppose said circuit boards and said second contact free ends engaging said body at said second openings at a location spaced apart from said second contact first free ends, said contact arm portions being deflectable toward said circuit board when said connector is inserted into a cigarette lighter receptacle, whereby deflection of said contact arms moves said second contact base portions into more firmer contact with said circuit board.

19. The connector as defined in claim 18, further including an exterior flexible covering that surrounds a portion of said body.

* * * * *